United States Patent [19]

Metais

[11] Patent Number: 4,865,725

[45] Date of Patent: Sep. 12, 1989

[54] DEVICE FOR THE COLLECTION OF VARIOUS SUBSTANCES PRESENT IN A LIQUID

[76] Inventor: Jacques J. Metais, 72, rud due Cherche-Midi, 75006 Paris, France

[21] Appl. No.: 81,851

[22] Filed: May 27, 1987

Related U.S. Application Data

[63] Continuation of Ser. No. 691,571, Dec. 11, 1984, abandoned.

[51] Int. Cl.[4] ..... B01D 1/40

[52] U.S. Cl. ..... 210/136; 210/170; 210/242.3; 210/923

[58] Field of Search ..... 210/242.1, 242.3, 123, 210/923, 136, 776, 170; 405/68

[56] References Cited

U.S. PATENT DOCUMENTS

| | | | |
|---|---|---|---|
| 3,494,132 | 5/1973 | Logan | 405/68 |
| 3,959,136 | 5/1976 | Ayers et al. | 210/242.3 |
| 3,966,615 | 6/1976 | Petchul et al. | 210/923 |
| 4,146,344 | 3/1979 | Steen et al. | 405/68 |
| 4,391,707 | 7/1983 | Gordon | 210/242.3 |

*Primary Examiner*—W. Gary Jones

[57] ABSTRACT

Devices enabling to collect substances dispersed in a liquid or floating on the surface of a liquid. The device may be configured as a floating barrier, for example a boat or a buoy. It comprises at least a housing (1) communicating with the liquid through orifices (3), (5) fitted with shutters (4), (6), and with the atmosphere through orifices (2). A certain alternating variation of the level of the surface (S) of the liquid with a respect to the housing is determined, and maintains a circulation of streams between the liquid medium and the housing. Substances of various natures and densities, brought by the streams (a) entering the housing are collected by the latter, they may be conveyed up to the discharge ports. The invention may be applied for example to combat chronical and accidental sea pollutions, and to collect various samples of said marine medium.

9 Claims, 4 Drawing Sheets

FIG. 7A
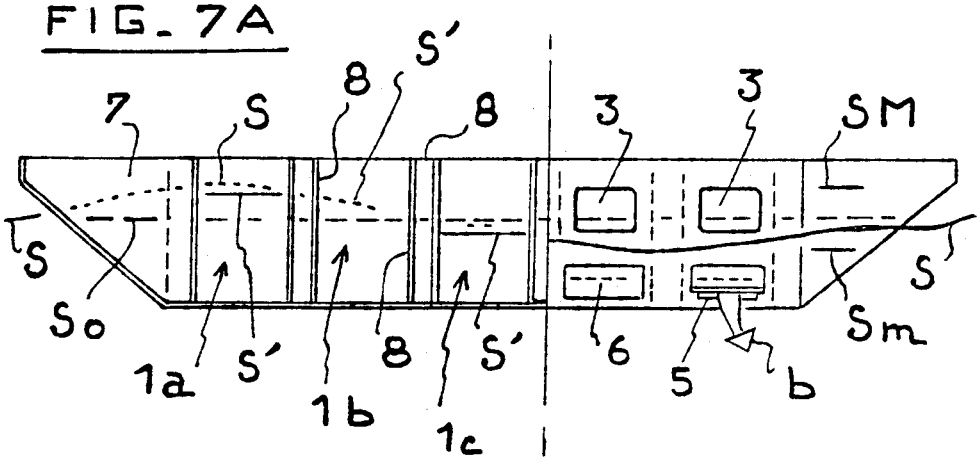
FIG. 7B
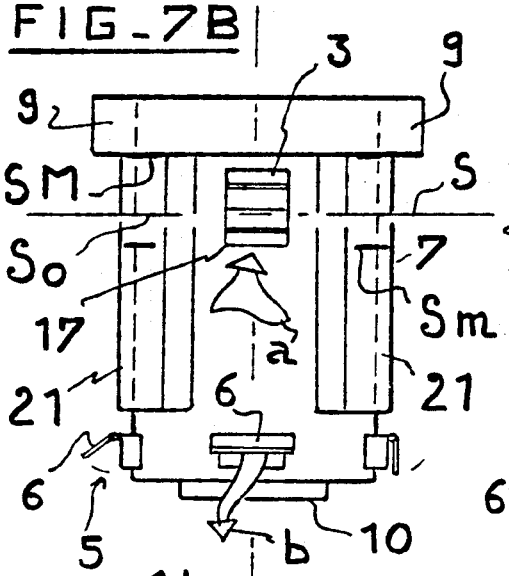
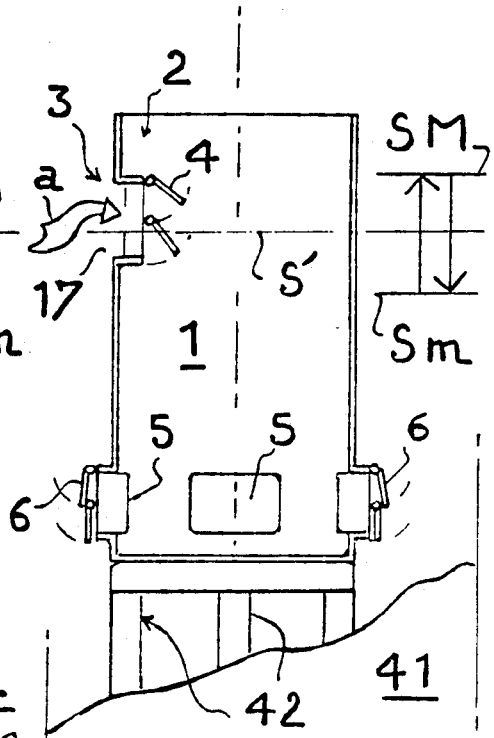
FIG. 7D
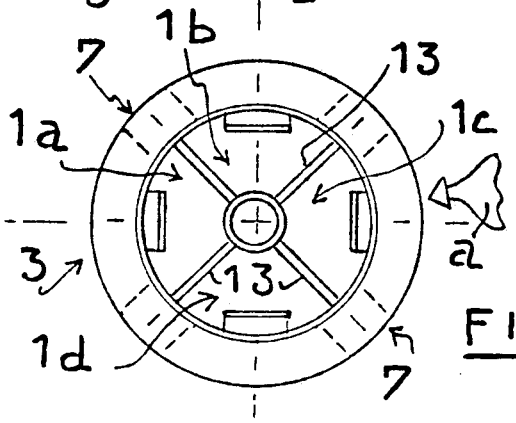
FIG. 7C

DEVICE FOR THE COLLECTION OF VARIOUS SUBSTANCES PRESENT IN A LIQUID

The present application is a continuation application of the prior application serial No. 691,571 filed on the Dec. 11, 1984, now abandoned.

TECHNICAL FIELD

This invention relates to the means for collecting substances in a liquid, and especially to the collecting devices utilizing the force of the waves in sea environment.

PRIOR ART

The idea is not new which consists to make use of the energy of the waves for filling up basins with sea water. The English patent A.D. 1869 No. 2 632 describes a rising device having a tunnel like a funnel which receives the waves, the tunnel ending in a vertical duct fitted with stop back valves. There is a description of a method for utilizing the force of the waves in the French patent No. 532 574, published 1922. According to this method, a slope bank is built across the direction of the waves, and the waves can rise on this bank up to an elevated basin. This method is explained again in the patent application EP - 0 018 340 and used for filling up a basin provided with filters which can gather valuable substances. This basin is provided with an outer ramp. The waves can enter into the basin only by rising up the ramp to a level which is higher than the normal level of the crests of the waves. One can observe that this apparatus can only work when the edge of the entry and the ramp are upstream to the basin with regard to the direction of the waves. The filling up of the basin is made possible inasmuch as the apparatus is utilizing the kinetic energy of particles of water, these particles moving on approximatively circular paths, and not only the variations of the level of water in relation to the basin. Moreover, according to this method, the water flowing into the basin can only come from the most superficial part of the liquid, and that is a serious disadvantage. The ramp and the basin must be positioned with precision, and that is an other disadvantage. The device which is described in the patent application EP - 0 005 122 is designed for collecting hydrocarbon slicks from the surface of water. It is composed of floating tanks which are open at the top and which can freely communicate with the liquid through apertures which are made in the bottom. According to the description of the process that appears in this document, the coming waves flow over the edges and into the tanks. Thus it is implied that the device has a definitive positioning, as the flows coming into the tanks have necessarily the same direction as the waves. This device has no means which could permit to give a definite direction to the currents which can flow over the edges of the tanks and through the apertures. In practice, each peak of a wave may not carry more than a small amount of light substances.

The French patent No. 2 390 551 describes a device comprising a pump which is set in motion under the action of the swell on a float. It also comprises a tank which is in communication with the superficial part of the liquid through a collection of pipes which are set around the tank. Generally speaking, devices having large moving parts which are exposed to wave action are not really adapted to sea environment.

DESCRIPTION OF THE INVENTION

The invention gives the possibility to utilize the vertical rising and falling motions of the surface of a liquid in relation to a tank in order to keep a circulation of liquid flowing between the liquid environment and the tank. These alternate vertical motions can be caused by a roughness of the said surface, that roughness not having necessarily the characteristics of a swell. The only moving components, which are required for the working of the devices in accordance with the invention, are closing means fitting some apertures. The flows of liquid which may carry substances to be gathered into the tank can come from any direction, that is the device does not need to be positioned with respect to the direction in which a swell is propagating. These flows can originate in the superficial part of the liquid element and also at deep levels in the midst of the liquid element. So, they can bring, into the tank, light substances floating on the surface of the liquid and also substances being dispersed in the midst of the liquid and substances having a density higher than the density of the liquid. The tank can be provided with various separating means, in accordance with the characteristics of the substances which are to be gathered. So, it is possible to design different embodiments of the invention, each one being suitable for a specific use, and namely devices really suited to the sea conditions and which can be convenient for fighting pollutions with efficiency, accidental as well as chronic pollutions, by utilizing the free energy provided by the environment.

The device in accordance with the invention comprises at least one enclosure making a duct or a tank in free communication with the atmosphere and having at least two apertures for communication with the liquid element, that is to say at least one inlet aperture and at least one outlet aperture. Entering currents originating in the liquid element can flow through the inlet aperture and outflows which originate in the liquid which is in the enclosure can come out through the outlet aperture. Each one of the apertures for communication with the liquid is fitted out with a mobile closing organ, or valve, which determines a definite direction for the currents which can flow through the aperture. Communication between the enclosure and the atmosphere is preferably kept separate from the apertures for communication with the liquid element.

The surface of the liquid element being choppy or rough, that surface rises and falls in relation to the device, in an alternate way. The device may be fixed on the bottom, or, if the device is a floating one, it comprises means which can determine a definite alternate variation of the relative level. In order that the alternate motions of the said surface might be, by themselves, sufficient to determine the working, the lower edge of the inlet aperture is situated at a level which is beneath the highest level that the said surface can reach, in relation to the device, in definite circumstances. This highest level can be reached without the help of any possible action of the device to the vertical motions of the said surface.

The process is as follows : when the surface of the liquid element, or outer surface, rises in relation to the enclosure, an incoming flow enters the enclosure by opening the valve of the inlet aperture, and the surface of the contained liquid, or inner surface, rises. At that time, the valve of the outlet aperture is closed. When the outer surface falls in relation to the enclosure, the valve of the outlet aperture opens, then an outflow comes out of the enclosure and the inner surface falls. At that time, the valve of the inlet aperture is closed. These phenomena occur whatever the positioning of the device may be with respect to the direction in which a swell is propagating. For example, according to a possible positioning, the inlet aperture can be sheltered from the waves.

The inlet aperture can be situated at different places in relation to the average level of the outer surface in relation to the device. The inlet aperture can be continuously submerged, and it is also possible that, successively, it will be at least partially submerged and then completely emerged. The outlet aperture can be placed in positions which are comparable to those of the inlet. The outlet aperture will be situated either at the same level as or at a lower or higher level than the inlet aperture.

The device includes at least a means of picking up and collecting substances to be gathered which are brought in the entering currents. Said substances can be liquid, semiliquid and solid, they can have a higher density, the same density and a lower density than the density of the liquid. The arrangement of the inlet apertures in relation to the outlet apertures is a simple means of gathering some substances into the enclosure.

The invention makes it possible to build devices which can collect various floating substances. In that case, the inlet apertures are placed in such a way that the entering flows can originate in the superficial area of the liquid element. The floating substances which are carried in these flows will compose a superficial layer in the enclosure.

In accordance with this embodiment of the invention, the lower edges of the inlet apertures are positioned between the upper level and the lower level that the external surface can reach in relation to the enclosure, and the outlet apertures open into the inside of the enclosure at a level which is lower than the level of the inlet apertures. The enclosure is provided with inner partitions which direct the circulation of the contained liquid. The outflowing currents originate in the lower part of the enclosure, at a certain depth beneath the layer of the light substances which have been collected.

Within the scope of the invention, one can also build devices having the capability of receiving flows originating in the midst of the liquid element at a certain depth. These devices can also collect non-floating substances. For example, the inlet apertures are situated at a level which is lower than the lowest level of the external surface in relation to the device, so that the inlet apertures are constantly submerged, and further the lower edges of these inlet apertures are positioned at a certain level above the bottom of the enclosure. The outlet apertures are situated at a higher level than the level of the inlet apertures and they are disposed in such a way that the outflowing currents can originate very close to the surface of the liquid which is in the enclosure. Further, the device comprises at least one means for giving a sufficient speed to the inflowing currents, for them to be able to carry substances having a higher density than the liquid. These substances will settle on the bottom of the enclosure. Supplementary separating devices, such as wire meshes and filters, will be able to hold back substances having the same density as the liquid. The bore of the inlet apertures will be chosen, taking into account the quantity of liquid which is contained in the enclosure and the variations of this quantity which can occur in certain conditions of utilization. In this manner, definite speeds of the inflowing currents can be obtained.

A device designed for collecting floating substances can have inlet apertures with their lower edges positioned at a level which is above the lowest level that the surface of the inner liquid can reach inside the enclosure. The inner surface can still be situated at this lowest level when the external surface rises above the level of these lower edges. Then, the inflowing currents can pour into the enclosure.

In accordance with a variant of the invention, at least one of the apertures for communication with the liquid element has a closing means, or valve , which is fitted with a means of control. The means of control blocks the opening of the said valve when the difference in level between the external surface and the inner surface is lower than a given value, and this means of control permits the opening of this valve when the said difference in level is at least equal to the said value.

The alternate variation of level of the surface of the liquid element in relation to the enclosure can be determined, when the surface is not calm, by a structure ensuring the enclosure a near motionlessness in relation to the average level of the surface. The enclosure can be also built on the bottom of an aquatic environment.

In accordance with an advantageous embodiment of the invention, the device comprises at least one unit having a very low density and giving to the device a positive buoyancy in water. When the surface of the liquid element is not calm, this unit also determines the said alternate variation of the level of the external surface in relation to the enclosure.

A device in accordance with the invention may be composed of a plurality of compartments, each one of them being an elementary enclosure. According to one example, each compartment comprises at least two floors which communicate one with another through ways which permit the flowing of inner currents from the inlet apertures up to the outlet apertures. According to how the inlet apertures and the outlet apertures are placed, and according to the arrangement of the inner partitions, each compartment can receive, either floating substances which are brought by the inflowing currents originating close by the external surface, or non-floating substances which are carried by currents originating at a certain depth in the midst of the liquid element. One device may be composed of compartments having different functions. Means of pumping enable the liquid substances which have been collected to drain off.

At least one of the horizontal dimensions of a device including several compartments may be chosen so that, in given conditions, a certain variation of the level of the external surface is determined in relation to each one of the compartments. The device may be circular shaped, the compartments being separated by radial partitions device designed for collecting light substances floating on water may have the elongated shape of a boat, in that case the compartments being disposed one behind the other lengthways. Means of propulsion and means of steering are provided, and also means of connecting several devices in such a way that certain relative motions are allowed.

In accordance with another advantageous embodiment of the invention, the device is a floating barrage or fence which is able to gather hydrocarbons floating on the sea surface and which also has the capability to carry these collected substances up to one of its ends, the operation being brought about under the action of the swell. The barrage is made up of a flexible floating structure, that structure being inflatable and composed of several floats, and of pieces of cloth or flexible sheets. These pieces of cloth, or sheets, are connected together and to the said structure by means of an attachment which makes it possible to separate these components.

This barrage comprises a multiplicity of compartments which are placed one after the other lengthwise. Each compartment includes two floors which are superposed and communicate with each other through openings which are fitted with valves, these valves permitting the flow of downward currents and barring the way to current having an opposite direction. The whole of the upper floors is in communication with the liquid element through inlet apertures which are close to the waterline, and the whole of the lower floors is in communication with the liquid element through outlet apertures which are situated in the lower part.

The lower floors communicate through openings which are fitted with valves, which permit the flow of inner currents going lengthways in a definite direction, from one end up to the second end of the barrage. These valves prevent the flow of currents in an opposite direction. The said second end of the barrage comprises at least one evacuation aperture.

The barrage is flexible, but nevertheless, the flexibility is sufficently limited so as to determine, when the surface of the liquid element is rough, the vertical rising and falling motions of the external surface in relation to the compartments. Under the action of these movements, quantities of liquid coming from the external superficial layer are dragged into the upper floors and then into the lower floors, where the substances which are to be recovered separate off from the liquid contained and float on the surface of that liquid. Water which has been brought by the entering currents is drained out through the outlet apertures. Inner longitudinal currents flow into the lower floors and carry the substances which are caught in these floors up to the end of the barrage, that end having a draining aperture. These currents flowing lengthways are caused by the variable differences in level between the quantities of liquid which are contained in the successive compartments. The walls of the lower floors are made of cloth, are very supple, and the capacity of each one of these floors can vary within certain limits. Certain differences in level between the external surface and the surface of the liquid inside each compartment, the shocks of the crests of the waves, and certain superficial external currents can have a favourable effect on the longitudinal flow of the substances captured.

The barrage comprises means for adjusting the longitudinal flexibility, which enable the determination of a certain amplitude of the vertical motions of the external surface in relation to each compartment. The inflating pressure of some longitudinal floats can be raised or reduced. Longitudinal cables are contained and can be slid inside sheaths which are permanently fixed on longitudinal floats. The ends of the cables are connected to the ends of the inflatable structure by means by which they can be tightened or slackened.

The barrage also comprises means which permit a control of the buoyancy and of the equilibrium, or trim, such as floats, the volume of which may vary, disposed on each one of the lateral walls. The said floats which are placed on either side of the barrage can be inflated and deflated independently of the similar floats which are situated on the other side.

According to one example, the mobile closing means, or valves, fitted at the openings, are made of pieces of cloth or of sheets of a supple material, and these pieces or sheets are linked with netting. The deformation of the valves and the netting, and the rubbing of them together, will impede the forming of a deposit of viscous substances on these elements which thus will be cleaned almost continuously.

Means of mooring and towing are provided for, and also connections giving the possibility of assembling several barrages together end to end and so forming a long barrage or a vast enclosure, the wall of which will be made of the barrage itself. Such an enclosure will have the capability of sucking up an external slick of floating substances, or a slick inside itself, and to carry these substances towards tanks.

The main worthwhile effects of the invention are now expounded. The invention allows the building of simple and solid devices which are adapted to sea environment and have the capability of collecting a wide range of substances by utilizing the energy provided free by the environment. The working of these devices does not require any mechanical means which are fragile and liable to corrosion. The devices in accordance with the invention can bring about a flow of liquid between various parts of a liquid element and an enclosure. That enclosure can receive flows coming from a superficial part of the external liquid and also flows originating at a certain depth in the liquid. The currents of liquid entering the enclosure can reach the inlet openings in any directions. The devices in accordance with the invention can then operate whatever their positioning, and mainly the positioning of the inlet openings, with respect to the direction in which a swell is propagating. That capability facilitates the start of the operation. There is no need for the inlet openings to remain in a definite position in relation to the average relative level of the surface of the liquide element. Thus, the devices in accordance with the invention may have various shapes and sizes. It is possible to design rigid devices or devices which may have a varying shape such as the barrage which has been described. These devices are capable of operating in very different weather conditions, under the effect of a choppiness of the liquid surface which may have any characteristics, and also under the effect of a heavy swell.

SHORT DESCRIPTION OF THE DRAWINGS

The accompanying drawings and the corresponding parts of the specification explain the invention in more details. However, the invention is not limited to the examples which are expounded.

FIG. 1 and FIG. 2 illustrate a first embodiment. They show an apparatus, in accordance with the invention, which has the capability of gathering floating substances. It comprises at least two collecting compartments, each one working independently from the other. The part of each illustration which shows a compartment also illustrates a phase of the working.

FIG. 3 and FIG. 4 illustrate a second embodiment. They show an apparatus, in accordance with the invention, which has the capability of collecting substances whose density is higher than the density of the liquid. The device comprises at least two independant collecting compartments. The part of each drawing which shows a compartment illustrates also a phase of the working.

FIG. 5 and FIG. 6 illustrate a third embodiment of a device in accordance with the invention. The device is an inflatable, flexible, floating barrage which has the capability of collecting hydrocarbon slicks from rough seas and which can also carry the pollutant up to tanks or boats. The left part of FIG. 5 shows the external appearance of one of the sides of the barrage, and the right part of that illustration shows the inner arrangement. FIG. 6 is a schematic cross-section view.

FIG. 7A shows a boat-shaped device designed for collecting various floating substances. The left part of FIG. 7A shows a portion of the inside of the boat, and one end. The right part of FIG. 7A is a side view of the other end of the boat.

FIG. 7B is a side view of a buoyant device, similar to a buoy, which can collect floating substances.

FIG. 7C is a plan view of the device of FIG. 7B.

FIG. 7D shows the interior of a tank which is fixed on the bottom of a body of water. The tank can collect floating substances.

EXAMPLES OF EMBODIMENT

Figure 1:
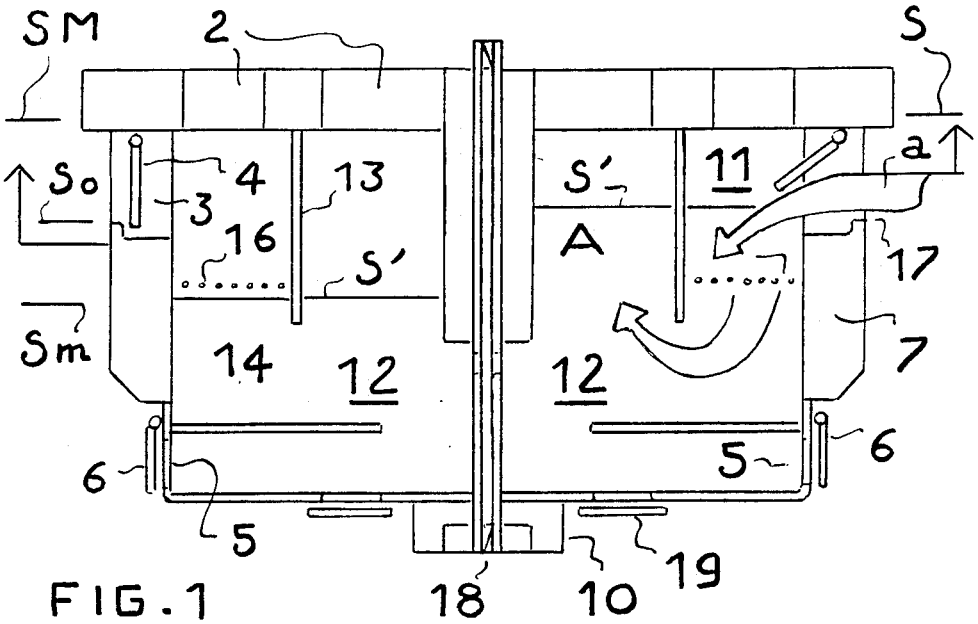
Figure 2:
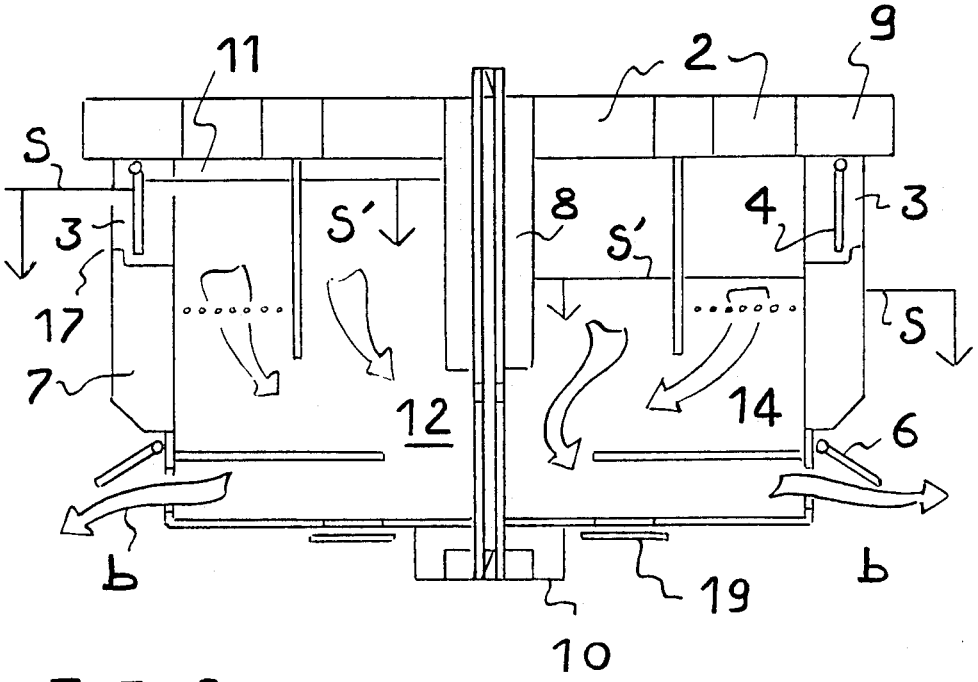

According to a first example which is illustrated FIG. 1 and FIG. 2, a floating tank comprises several independent compartments. Each one of them is in communication with the atmosphere, through openings (2), and with the liquid element through one inlet aperture (3) and one outlet aperture (5). The inlet aperture is fitted with a valve (4), and the outlet aperture is fitted with a valve (6). The caissons (7) and (8) determine the buoyancy. The volume (9) are reserves of buoyancy. A ballast (10) is placed in the lower part of the tank. Water-ballasts (not shown on the drawing) permit a control of the balancing position.

Each component comprises an inlet floor or inlet chamber (11) and a lower floor (12). A partition (13) divides these floors which communicate one with another through a wide opening (14) which is fitted out with a grid (16). The lower edges of the inlet apertures (3) are very close to the average level (S o) of the external surface (S) in relation to the tank. The outlet apertures (5) are situated at a level which is beneath the lowest level (S m) that the external surface (S) may reach in relation to the tank. Some inner partitions direct the flow of the inner currents.

When the surface of the liquid element is rough, a certain alternate variation of the level of that surface (S), in relation to each compartment, is determined by the very shape of the device. That device can be provided, at a certain depth beneath the waterline, with submerged volumes (21), so that the amplitude of the vertical motions of the device may be distinctly smaller than the amplitude of the swell.

According to a variant, the device has a number of collecting compartment,s its draught is not very important, but at least one of its horizontal dimensions is long enough, with respect to the wavelength of the swell, so that there will occur a certain variation of the level of the external surface in relation to each compartment. The device may be circular shaped, approximatively radial partitions dividing the device into compartments. It can also have the shape of a hull of a boat having a plurality of compartments disposed one behind the other lengthways. For instance, these compartments may form two parallel series.

When the surface (S) of the liquid element is not calm, the level of that surface varies, in relation to each compartment, between an upper level (S M) and a lower level (S m). As the external surface rises, with respect to a compartment, above the lower edge (17) of the inlet aperture (3), an entering current (a) originates in the vicinity of the external surface and flows into the compartment. The inner surface (S') rises inside the compartment. The outlet aperture (5) is then closed up by the valve (6).

When the external surface (S) goes down, in relation to a compartment, an amount of the liquid that the lower part of the compartment contains flows out through the outlet aperture (5) and it forms an outgoing flow (b). The surface (S') of the liquid which is held inside the compartment goes down. The valve (4) closes up the inlet aperture (3).

The device may be balanced so that the lower edge (17) of the inlet aperture is positioned slightly above the lower level (S m) of the external surface (S). In that case, the inner surface (S') rises with a certain delay in relation to the motion of the external surface (S), and the lower edge of the inlet aperture (3) forms an overflow when the entering current (a) begins to flow.

The entering currents (a) carry floating substances into the compartments, such as dispersed substances or substances constituting a slick. Some solid bodies will be held back by the grids (16) inside the inlet floors (11).

The liquid and semiliquid floating substances are carried into the lower floors (12), and they form the upper layer of the liquid which is contained inside these floors. The out-flowing currents originate deeply enough underneath the layer of these substances (A) for them not to sweep them away. Various means of separation may be employed as well.

Some devices may be provided with a pipe (18) in communication with the lower floors and allowing the pumping out of the collected liquid substances, either through an emerged draining opening, or through a second opening which is submerged. Furthermore, it is possible also to put each compartment in communication with the liquid element by means of a sluice-gate (19) permitting it to be filled up.

According to a variant, the device is fixed to the bottom (41) of a body of water by means of a structure (42) which keeps the device motionless.

Figures 3, 4:
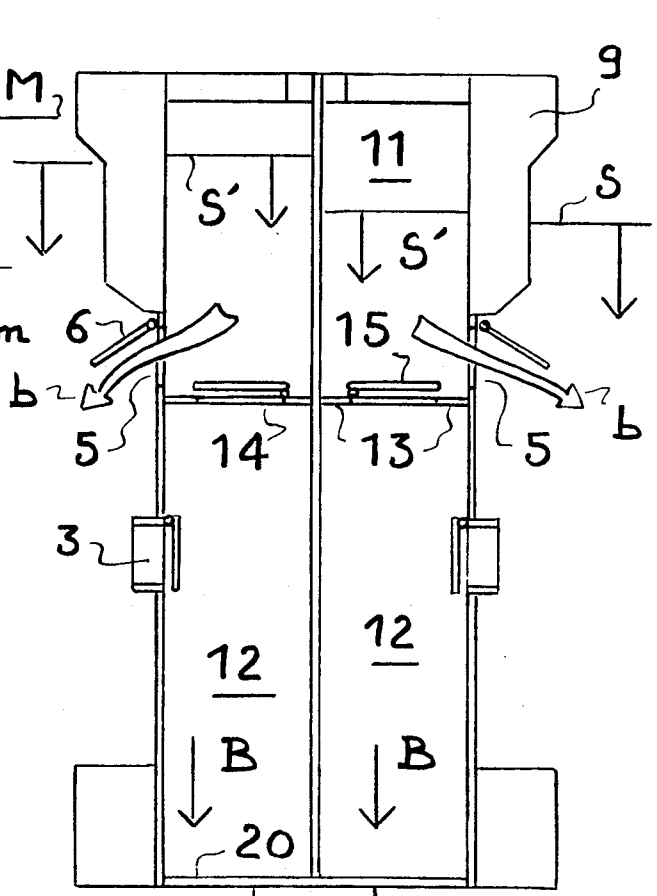

FIG. 3 and FIG. 4 on sheet number 2 illustrate a second realization. The device which is shown comprises independent compartments. Inside each compartment there are two superposed floors (11) and (12) which are divided one from the other by a partition (13). The floors belonging to a compartment are in communication one with another through an opening (14). That opening (14) is fitted out with a valve (15) which permits the flow of currents of liquid from the lower floor (12) towards the upper floor (11). The lower floor is in communication with the liquid element through an inlet aperture (3) which is provided with a valve (4). The lower edge (17) of this aperture (3) is positioned at a certain height above the wall (20) which is the bottom of the lower floor. The upper floor (11) has an outlet aperture (5) which is provided with a valve (6). This upper floor is open to the atmosphere through openings (2).

The caissons (7) and (8) and some submerged volumes (21) ensure the buoyancy of the device, and, when the surface of the liquid element is rough, they determine a certain alternate variation of the level of that surface in relation to the compartments. The draught may be considerable .

As the external surface (S) rises in relation to a compartment, an entering current (a) comes into the lower floor (12), and a current (a b) opens the valve (15) and flows through the communicating opening (14) which is between the floors. The inner surface (S') then rises. At that moment, the outlet aperture (5) is closed up by the valve (6).

During a phase of descent of the external surface (S) with regard to a compartment, the valve (15) closes up the opening (14) which permits a communication between the floors. The inlet aperture (3) may be also closed up by a valve (4). An outflow (b) originates near the inner surface (S') which then goes down. This outflow goes out of the upper floor (11) through the outlet aperture (5).

The entering currents can be swift-flowing enough for some substances (B), the density of which may de distinctly higher than the density of the liquid, to be carried into the lower floor (12). The upward currents (a b) flow at intervals, and they may be less fast than the entering currents. Thus, the said substances (B) can separate from the liquid which is contained in the lower floors, and form a deposit on the bottom (20) of these floors.

At the beginning of each upward phase in the motion of the external surface (S) in relation to a compartment, the start of the entering current (a) can be delayed until the difference in level between the external surface (S) and the inner surface (S') reaches a certain value, or until the external surface rises to a definite level. According to one example, the valve (4) of the inlet aperture is fitted out with a locking mechanism controlled by a small external float which can move up and down with the surface of the liquid element. The falling motion of the float is limited by a stop. When occupying its lowest position, the little float is situated above the lower level of the external surface, and then the opening of the valve is not allowed. As the float begins to move up with the external surface, the valve can fly open and let enter a swift flow. That valve, or the valve (15) of the communicating opening which is between the two floors of a compartment, might be fitted out with a magnetic closing device.

Figure 6:
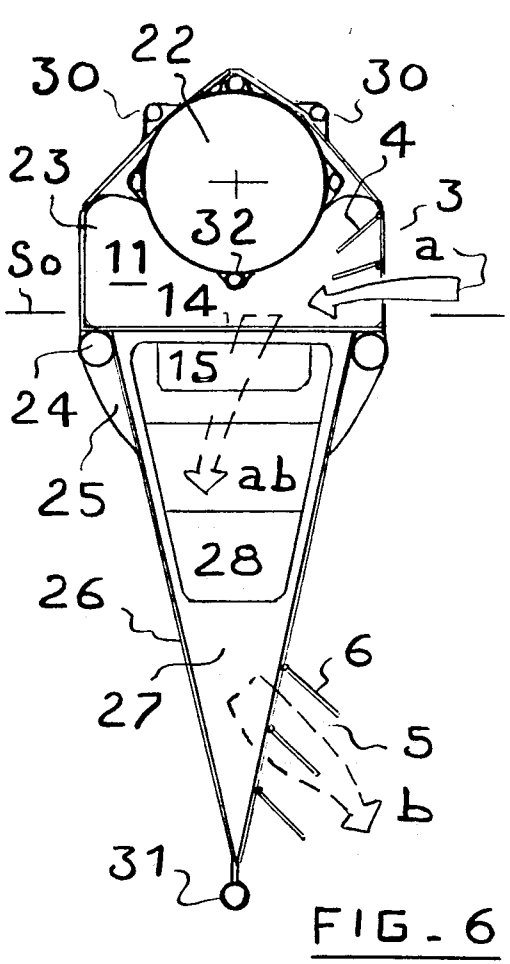
Figure 5:
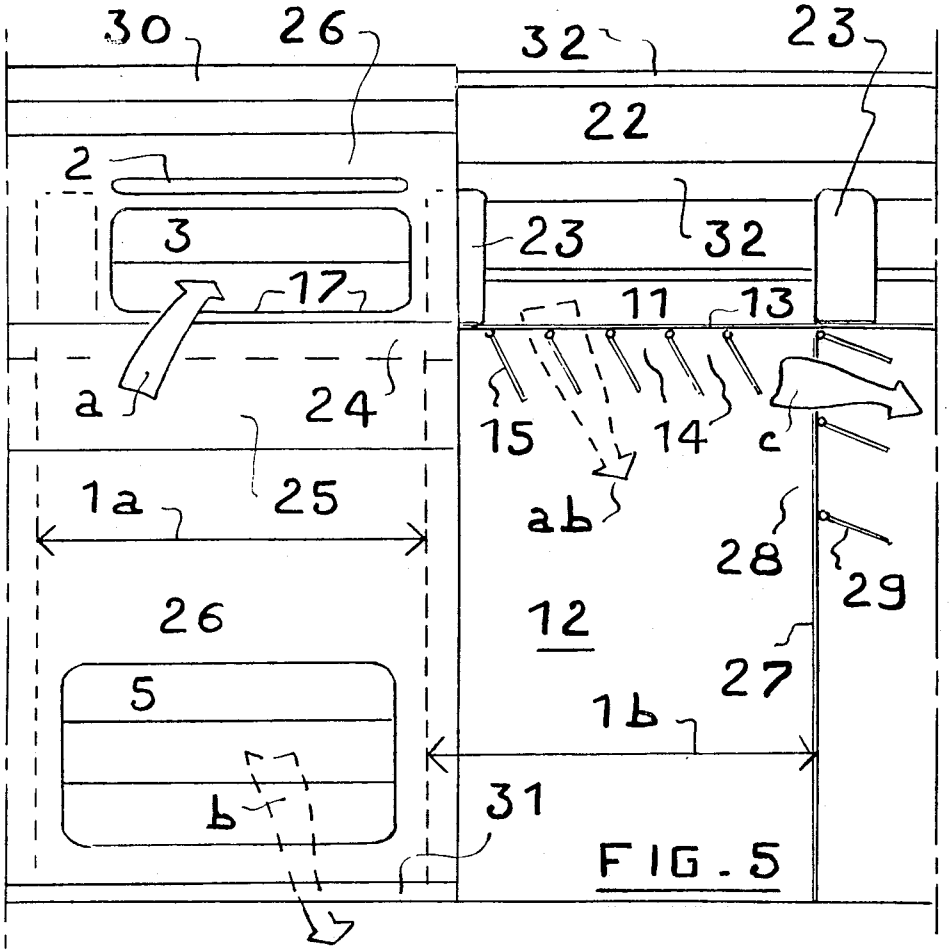

FIG. 5 and FIG. 6 illustrate a third embodiment. (see sheet 3). According to that embodiment of the invention, the device is a floating barrage which has the capability of sucking up oil slicks from rough seas, also separating oil from the water which is in the gathered mixture, and carrying the pollutant to a storage enclosure. Some collecting compartments (1 a), (1 b), . . . etc, are disposed in line from one end to the other end of the barrage. Each compartment comprises two superposed floors (11) and (12) which are separated one from the other by a horizontal partition (13). The shape and the buoyancy of the barrage are ensured by an inflatable structure comprising : a longitudinal float (22) which is partitioned and placed in the upper part of the barrage, this float being of the same length as the barrage ; some transversal floats (23), each one of them separating two upper floors (11) one from the other ; some lateral floats (24) ; some floats (25) having variable volumes. The walls and the partitions are made of cloths which are linked together and to the inflatable structure by means of lacings or by some other removable connecting means. It is possible to open every inner volume, to carry out cleaning and various inspections.

Each upper floor (11) is in communication with the atmosphere through openings (2), and with the liquid element through inlet apertures (3) which are placed on one of the lateral walls (26) at about the level of the waterline. The two floors of each compartment are in communication one with the other through a wide opening (14). Each lower floor (12) has an outlet aperture (5) which is placed on a lateral wall (26), in the lower part of this wall. The inlet apertures (3), the communicating openings (14), and the outlet apertures (5) are respectively fitted out with valves (4), (15) and (6). The arrangement of these valves allows the flow of currents of liquid which originate in the vicinity of the surface (S) of the liquid element, and enter the upper floor (11) and then the lower floor (12), and go back to the liquid element underneath the surface.

The lower floors (12) are in communication between them. The transversal partitions (27), between the lower floors, have openings (28). These openings (28) are provided with the valves (29) which permit the flow of inner currents in a determined direction from one end to the second end of the barrage. The last compartment, which is downstream from the other compartments in relation to the direction of the inner flow, has an evacuation aperture on each one of the lateral walls. Some connecting means for fastening an outside draining duct are placed close to each evacuation aperture. Closing means are also provided.

According to an example of construction, the valves are made of pieces of cloth or sheets of a supple material which are approximately rectangular in shape. Each opening has several similar valves. One of the long sides of each piece is fixed on a netting which is placed between the edges of an opening and the second long side can slightly overlap on a short width, either the fixed edge of an other piece, or one of the edges of the opening. The deformation and the rubbing of the valves on the netting will cause a continuous cleaning of these elements.

Very resistant cables or ropes are disposed from one end up to the second end of the barrage inside sheaths which are fixed on the walls of the barrage, namely : lateral cables (30) and a lower cable (31) the weight of which contributes to the stability of the barrage. These cables may be connected, at each of their ends, to mooring lines or to towing ropes. A limited sliding of each cable inside its sheath is allowed for. Each end of the barrage is provided with connecting means, which enable several independent barrages to be joined end to end, and which can bar the way of an oil slick between the connected ends.

The flexibility of the barrage is conditioned by that of the upper float (22), the envelope of which has longitudinal sheaths containing cables (32). Each of the ends of each cable is connected to the casing of the float by means of a device which makes it possible to slacken or tighten that cable. In this manner, the flexibility of the barrage is limited and it can be modified according to the tightness of the cables (32) and according to the inflating pressure of the floats.

Some floats (25), with gussets and adjustable volumes, are placed on the lateral walls (26). Inflating tubings make it possible to inflate and deflate, from one of the ends of the barrage, the floats (25) which are placed on one side independently of those floats which are placed on the other side. So, it is possible to shift the level of the waterline, and also to give a certain list to the barrage, for instance in order to control the listing motions which are caused by a cross swell.

The terminal compartment, which is upstream from the other compartments in relation to the direction of the inner draining flow (c), comprises a supple container which holds a liquid cleaning product. This product can seep away, either continuously or periodically, under the effect of the deformations and the variations of the volume of that compartment. It can flow into all the lower floors up to the draining apertures and detach any viscous deposits which might cover the inner walls.

Straps, placed on the upper structure, bear rings or loops by which the barrage can be linked to mooring lines and also for it to be towed to form different configurations. Some parts of the lateral cloths are reinforced, to prevent wear and tear of the cloths in case of frequent grounding or beaching. The plurality of independent floating volumes ensures the buoyancy of the barrage in case several floats are deflated.

The flexibility of the barrage is limited by the described means of construction. The mooring means, the position in relation to a current, and the effect of a towing may change the flexibility. Thus, when the sea is rough, a certain alternate variation of the level of the external surface (S) in relation to each compartment is brought about. During the phases of the rising motions of the external surface (S) in relation to a compartment, the layer of the hydrocarbons to be recuperated is carried into the upper floor (11) with an entering current (a). The collected liquid may contain quite a large proportion of water.

As the external surface (S) goes down in relation to a compartment, the mixture which has been before collected flows down into the lower floor. The oil floats on the surface of the liquid which is contained inside that floor (12). Some of the water which is inside the lower part of that floor forms an outflow (b) through the outlet aperture (5). The separation of the collected mixture can continue, inside every compartment, during the phases of the rising motions of the external surface in relation to these compartments.

The inner currents (c), which flow lengthways underneath the horizontal partition (13), carry off the superficial layer of the liquid which is contained in the lower floors, and therefore the collected hydrocarbons up to the draining apertures which may be joined to storage tanks.

The preceding description shows that the invention includes a collection of devices whose shapes, sizes, the arrangement of the different components, constituent materials and applications can be very varied, as can be the modifications, variants and uses which may be designed by those who are skilled in the art.

INDUSTRIAL EXPLOITATION

Among various applications, the following may be quoted :

The fight against chronic and accidental pollutions of the seas. It is possible to realize rigid apparatus having various shapes and having the capability to clean-up certain coastal areas through a very long-lasting action. The described flexible barrage can be spread out on the open sea to recover hydrocarbons before the slicks reach the coast, in weather conditions which might preclude the using of other devices.

The collection of substances which are dispersed in sea water, such as valuable substances, by means of devices capable of receiving currents originating at a certain depth in the liquid element.

The gathering of specimens of marine living matter.

What is claimed is :

1. A device for collecting various light substances floating on a liquid the surface of which is choppy or rough, comprising :

a. a tank having at least one internal compartment in communication with the atmosphere through an upper aperture, said compartment being partly submerged up to an average level in a liquid external to said tank, so that, when the liquid surface is choppy or rough, said liquid surface may have alternate vertical movements with respect to said compartment, between a higher level and a lower level ;

b. said compartment having at least one inlet opening positioned below the highest level that the liquid surface can reach with respect to said compartment and near the said average level of the liquid surface, said inlet opening being fitted with an inlet valve, said inlet valve allowing liquid coming from the superficial layer of the liquid surface and floating substances to come into said compartment, said inlet valve preventing the outflow of the liquid and the floating substances which are contained inside said compartment ;

c. said compartment having at least one outlet opening positioned at a level beneath the level of said inlet opening and beneath the said average level of the liquid surface, said outlet opening being fitted with an outlet valve, said outlet valve allowing the liquid contained inside said compartment to flow out from the compartment, said outlet valve preventing the external liquid from coming into said compartment through said outlet opening ;

d. said inlet valve and said outlet valve being able to function automatically under the mere effect of the variations of level of the said liquid surface with respect to said compartment ;

e. said compartment comprising one upper chamber and one lower chamber, said upper chamber and said lower chamber being separated one from the other by a grid, and said compartment comprising also inner partitions which can direct the flow of the liquid and the floating substances contained inside said compartment ;

f. flotation means associated with said tank, said flotation means providing the tank with a positive buoyancy in the liquid.

2. The device of claim 1, wherein said inlet opening and said outlet opening are placed on the same wall of the compartment, these two openings facing the same direction, said inlet opening being positioned above said outlet opening.

3. The device of claim 1, further comprising at least two inlet openings which are placed on two distinct walls of said tank, one inlet opening being on a wall and facing a first direction, the second inlet opening being placed on another wall and facing a direction opposite to the said first direction, so that said tank be able to admit and to collect external liquid and floating substances coming from two opposite directions.

4. The device of claim 1, further having at least two outlet openings which are placed on two different walls of said tank, one of said outlet openings being positioned for facing a first direction, and the second of said outlet openings being positioned for facing a direction which is different from the said first direction.

5. The device of claim 1, wherein said tank is fixed to the bottom of a body of water by means of a structure which is able to give to the tank a near motionlessness with respect to the average level of the liquid surface.

6. The device of claim 1, further comprising submerged volumes which are associated with said tank and which are positioned at a certain depth beneath the waterline, said submerged volumes limiting the possible vertical movements of said tank in the liquid.

7. The device of claim 1, wherein said tank is circular in shape and comprises several independent compartments which are separated one from another by radial partitions, each of said compartments having one inlet opening fitted with an inlet valve and one outlet opening fitted with an outlet valve, each of said compartments being in communication with the atmosphere through an upper aperture, each of said compartments being able to collect floating substances.

8. The device of claim 1, wherein said tank has the elongated shape of a boat, said boat comprising a plurality of independent collecting compartments which are disposed one behind the other lengthways, each of said compartments having one inlet opening fitted with an inlet valve and one outlet opening fitted with an outlet valve, each of said compartments being in communication with the atmosphere, said boat being long enough, with respect to the wavelength of a swell occuring on the surface of a body of water, so that a certain variation of the level of the surrounding liquid surface may occur in relation to each of said compartments, when the liquid surface is rough.

9. The device of claim 1, wherein said flotation means includes upper floats extending horizontally away from the walls of said tank, said upper floats being positioned above the waterline, for providing said tank with a reserve of buoyancy.

* * * * *